United States Patent [19]

Whiteing

[11] Patent Number: 4,748,759

[45] Date of Patent: Jun. 7, 1988

[54] PERSONAL PROTECTION FIREARM

[76] Inventor: Roland G. Whiteing, 45 Duncan Road, Glenferness, Midrand, Transvaal Province, South Africa

[21] Appl. No.: 40,500

[22] Filed: Apr. 20, 1987

[51] Int. Cl.[4] ..... F41C 9/00

[52] U.S. Cl. ..... 42/1.09; 42/2; 42/69.01

[58] Field of Search ..... 42/1.09, 1.11, 2, 69.01, 42/39.5, 1.08, 1.16, 1.15, 1.14, 1.12, 52, 51; 63/1 R

[56] References Cited

U.S. PATENT DOCUMENTS

| | | | |
|---|---|---|---|
| 1,514,263 | 11/1924 | Scott | 42/1.11 |
| 1,897,992 | 2/1933 | Ailes | 42/1.09 |
| 2,001,405 | 5/1935 | Abbott | 42/2 |
| 3,018,578 | 1/1962 | Hill | 42/1.11 |
| 3,296,728 | 1/1967 | Kvavle . | |
| 3,583,088 | 6/1971 | Buck et al. | 42/69.01 |
| 3,707,793 | 1/1973 | Holton, II | 42/1.09 |
| 3,849,924 | 11/1974 | Whitlinger | 42/DIG. 1 |
| 4,135,645 | 1/1979 | Kimmell | 63/1 R |
| 4,241,850 | 12/1980 | Speer | 63/1 R |

OTHER PUBLICATIONS

Johnson Smith & Company, catalog, No. 133, 1929, "The Squirt Ring", p. 228.

*Primary Examiner*—Deborah L. Kyle
*Assistant Examiner*—Michael J. Carone
*Attorney, Agent, or Firm*—Mason, Kolehmainen, Rathburn & Wyss

[57] ABSTRACT

A firearm for personal protection purposes is provided which is particularly useful in close combat situations. The firearm comprises a support which is in the form of a finger ring which has a barrel defining a chamber and has a trigger operated firing mechanism operable by the thumb of the same hand of a person as that on which it is worn. The trigger is rotatably mounted to the side of the ring and is spring loaded towards a cocked position.

7 Claims, 2 Drawing Sheets

PERSONAL PROTECTION FIREARM

FIELD OF THE INVENTION

THIS INVENTION relates to a personal protection firearm of a nature which is easy to transport on a person's body and is also easily made available for use.

BACKGROUND TO THE INVENTION

Generally employed for the purposes of personal protection are handguns. Drawbacks of the usual handguns are that size and weight make the gun difficult to carry and conceal, or keep in a safe place. Also, where a handgun is used for self-defence, the gun has to be removed from its carrying position, often a holster, and such removal can be difficult for the user to achieve in a stress situation. When a handgun is used for protection, usually one or possibly two rounds are fired. Either the handgun has been removed from the user at such a juncture in time or the attacker has been struck and the gun is no longer required.

In consequence of the difficulties associated with using a handgun, and the delays in removing it from its carrying position, handguns are often removed from a would-be user prior to same being fired. This is particularly so in a close combat situation.

It will be appreciated that where a firearm contains only one or two cartridges it is important that it can be quickly and effectively fired. For this reason the trigger mechanism should be of a design which enables it to be quickly and easily discharged without requiring dextrous manipulation.

It is the object of this invention to provide a firearm which need not be removed from its carrying position prior to it being fired and which can be brought into an operative condition more easily than handguns in the form in which they are commonly known.

It is another object of this invention to provide a firearm particularly adapted for close combat situations and wherein the sighting and firing of the firearm can be achieved swiftly and easily.

SUMMARY OF THE INVENTION

In accordance with his invention there is provided a personal protection firearm comprising a support member shaped to be worn on a user's finger and assuming the form of a finger ring, a breech block and firing pin carried by the support member and defining the rear end to a barrel and associated firing chamber in the support member, the firing chamber being adapted to accommodate a cartridge therein, the barrel being axially slidable within a bore in the support member and spring biased towards the firing pin, the barrel having a lug fixed thereto extending through a slot in the support member such that the lug serves as a means for cocking and firing the firearm, a trigger mechanism being rotatably mounted to the support member, the trigger mechanism being in the form of a spring loaded notched plate the plane of which is substantially perpendicular to the lug, the axis of rotation of the plate being substantially perpendicular to the plate, the spring loading on the plate being such that when in use the lug is slid forward bringing the firearm to a cocked position the plate rotates to a position in which the notch engages the lug to hold the lug and barrel forward and cocked, and by rotating the plate to a position where the notch is disengaged from the lug, the lug and barrel slide backwards to fire the firearm.

The barrel will preferably extend parallel to the ring axis. A cover flap may be provided which covers the outlet end of the barrel in an inoperative condition and which serves as a flash protection in an operative position.

The firing pin can be carried by the breech block and may be fixed or replaceable relative to such breech block. The breech block is conveniently a screw-threaded plug removably associated with the support at the rear end of the barrel and is removable to provide access for loading the firearm. Such plug shaped breech block can be shaped so that the skirt thus formed can interfere with movement of the slide described above in a "safe" angular position of breech block but a recess in the skirts edge aligns with the slot in a "firing" position.

The caliber of the chambers or barrel may be of a small bore of the order of 0.22 inches or 5.5 mm. The chambers can be adapted to accommodate many different types of ammunition and, apart from standard bullets, hollow point and flat headed bullets can be used. Further types of lethal and non-lethal ammunition can be employed in the firearm of this invention, these including blank cartridges, flare firing cartridges, cartridges containing shot and also cartridges to propel drug darts, gas and the like. Also small rocket propelled and tracer cartridges could be projected from the firearm. In instances where the cartridges to be fired are non-lethal, the outlet end of the barrel can be choked such that live bullets cannot be properly chambered.

The support body may be interchangeable with a piece of ornamental jewellery on the endless band.

DETAILED DESCRIPTION OF THE DRAWINGS

Figure 1:
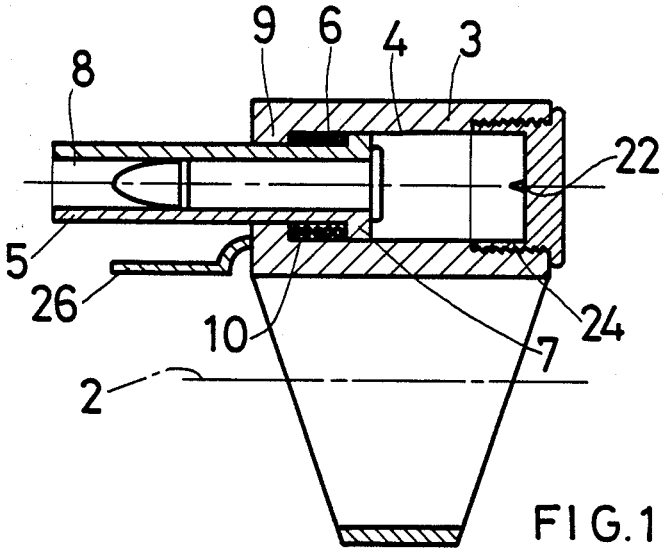
FIG. 1 shows a cross-sectional side view of a firearm according to the invention, with the firearm cocked.
Figure 2:
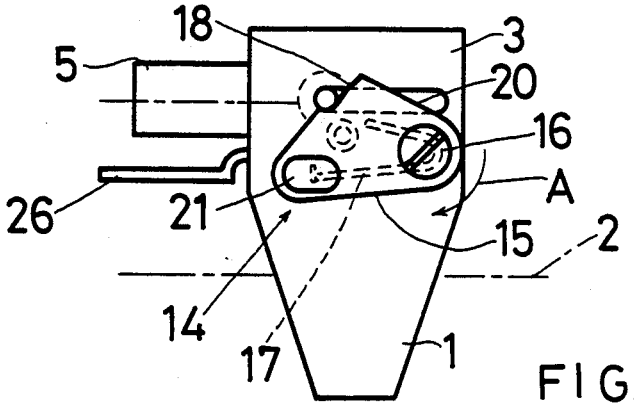
FIG. 2 shows a side view of the firearm of FIG. 1 with the firearm cocked.
Figure 4:
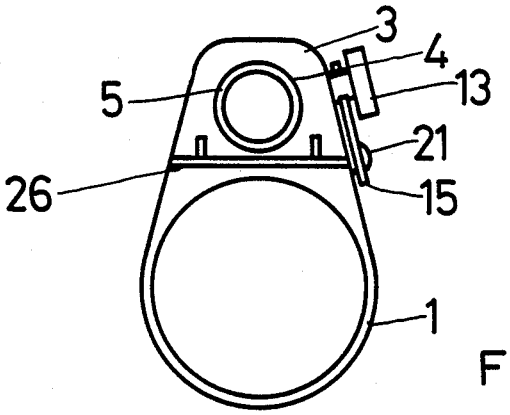
FIG. 4 shows an end view of the firearm in a cocked position.
Figure 3:
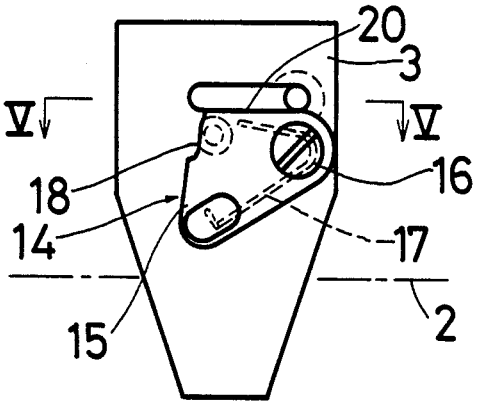
FIG. 3 shows a side view of the firearm at the point of firing.

The firearm shown assumes the form of a finger ring indicated generally by the numeral 1 which defines the support member of the firearm. The ring has an axis 2 which, in use, is to coincide with the axis of a wearer's index finger and has a body portion 3 of the firearm built up on the finger ring and shaped to form a bore 4 having its axis extending parallel to hat of the ring. An axially movable barrel 5 is located in the bore to define an annular space 6 between its outside surface and the inner surface of the bore and defines a chamber at its operatively inner or rear end. An outwardly directed flange 7 at said inner end is slidable on the surface of the bore.

The barrel is guided, at its operatively forward end 8, by an inwardly directed flange formation 9, at the outlet extremity of the bore. Thus, in the firing position in which the barrel is at its innermost position, it is supported at its front and rear ends by the flange 7 and flange formation 9 respectively.

The annular space 6 accommodates a compression spring 10 for operating the firearm and a radially extending slide member or lug 11 is secured to the barrel towards its flanged end 7. The slide member extends through a slot 12 in the side of the body portion of the support so as to be accessible by the thumb of a person wearing the ring. A suitable head 13 on the lug is engageable by a thumb of a wearer to cock the firearm. The barrel can thus be slid forward to compress the compression spring by pressing the lug forward.

A trigger mechanism for the firearm is shown generally at numeral 14. The trigger mechanism comprises a flat triangular shaped plate 15 which is rotationally mounted to one body portion of the ring through a screw member 16. A leaf spring 17 acts between the plate and the body portion 3 to urge the trigger to rotate around the screw member in the direction of arrow 'A'. The screw member passes through the plate towards one corner thereof.

A notched recess 18 is formed in a corner of the plate remote from the screw member. The spring 17 urges the plate 15 against the underside of the lug 11, the lug 11 preventing further rotation of the plate. A straight edge 20 of the plate is in contact with the lug. As the lug is slid forward to move the firearm to a cocked position the lug rides along this straight edge 20. As the lug passes the forward corner of the plate the plate will rotate further until the lug is located in the notched recess 18.

To fire the firearm the plate will simply be rotated in a direction opposite to that of arrow 'A'. This will take place by the wearer pulling down on a protrusion 21 projecting laterally from the side of the plate. As the lug moves out of the recess 18 it will be free to slide back along slot 12 together with the barrel and a cartridge carried in the barrel.

In order to effect firing of the firearm a firing pin 22 is set into a plug-shaped breech block 23 which screw-threadedly engages the end of the bore opposite the outlet end. The breech block is cup-shaped with the inner diameter of the cup, which is defined by a skirt 24, aligning with that of the bore to form a continuation thereof.

Figure 5:
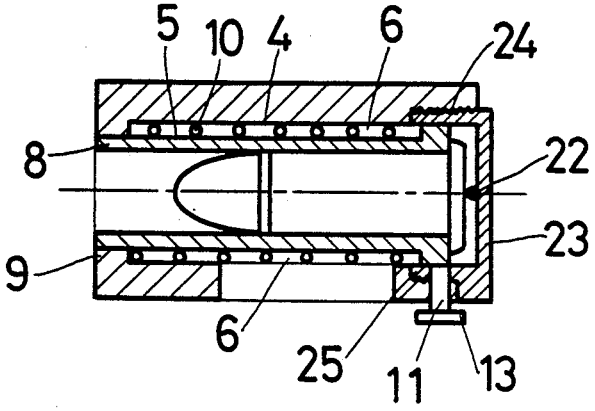
FIG. 5 shows a cross-sectional plan view of the firearm along line V—V of FIG. 3.

A deep notch 25 in the skirt 24 (see FIG. 5) is, in the firing position of the breech block, adapted to align with the slot through which the slide extends to enable the barrel to move rearwardly sufficiently far for a cartridge in the chamber to engage the firing pin 22 carried in the breech block. The firing pin 22 can be permanently fixed in the breech block or may be removable to provide for replacement thereof.

In other angular positions of the breech block the slide is prevented from moving rearwardly to a sufficient extent that a cartridge in the chamber will contact the firing pin. All such positions correspond to a "safe" position even when the firearm is cocked as the slide will simply engage the end edge of the skirt prior to a cartridge engaging the firing pin.

A cover flap 26 is hingedly attached to the front end of the firearm and is movable between two positions, one (as illustrated in FIG. 1) in which the end of the barrel and bore are closed by the flap, and a second one in which the flap is pivoted downwardly to extend roughly parallel to the axis of the barrel, and in which it is located to protect a wearer's finger against flashing produced by the firing of a cartridge.

In order to prepare the firearm for use the breech block is unscrewed entirely and a cartridge introduced into the chamber in which it is a light frictional fit. The breech block is replaced and either of the "safe" or "firing" positions can be chosen. Suitable indications are provided on the body of the firearm to show which position corresponds to which condition of the firearm.

In order to operate the firearm the slide is simply moved forwardly against the spring loading of the chamber which automatically opens the flap. The thumb of a person wearing the firearm can simply be employed to pull the trigger mechanism 14 downwards.

It will be understood that, with a finger ring of the above type located on a person's finger, and with the finger bent, the subcutaneous finger tissue expands to provide an extremely tight fit of the ring on a finger and, accordingly, enables the firearm to be aimed fairly accurately, at least sufficiently accurately for reasonably close combat situations. During firing the flap acts as a flash protector against burning by the burnt powder of a cartridge.

Numerous variations may be made to the above described embodiment of the invention without departing from the scope hereof. In particular the design of the support and, indeed, the breech block may be varied widely.

What I claim as new and desire to secure by Letters Patent is:

1. A personal protection firearm comprising a support member shaped to be worn on a user's finger and assuming the form of a finger ring, a breech block and firing pin carried by the support member and defining the rear end to a barrel and associated firing chamber in the support member, the firing chamber being adapted to accommodate a cartridge therein, the barrel being axially slidable within a bore in the support member and spring biased towards the firing pin, the barrel having a lug fixed thereto extending through a slot in the support member such that the lug serves as a means for cocking and firing the firearm, a trigger mechanism being rotatably mounted to the support member, the trigger mechanism being in the form of a spring loaded notched plate the plane of which is substantially perpendicular to the lug, the axis of rotation of the plate being substantially perpendicular to the plate, the spring loading on the plate being such that when in use the lug is slid forward bringing the firearm to a cocked position the plate rotates to a position in which the notch engages the lug to hold the lug and barrel forward and cocked, and by rotating the plate to a position where the notch is disengaged from the lug, the lug and barrel slide backwards to fire the firearm.

2. A personal protection firearm as claimed in claim 1 in which the axis of the barrel extends parellel to the axis of the ring.

3. A personal protection firearm as claimed in claim 1 in which a cover flap is provided for covering the outlet end of the barrel in an inoperative condition and is movable to function as a flash protector in the operative position.

4. A firearm as claimed in claim 1 in which the breech block is in the form of a plug engaged in an end of a bore through the support member.

5. A firearm as claimed in claim 4 in which the breech block is cup-shaped with the inner surface of the skirt defining the cup aligning with the bore in the support member.

6. A firearm as claimed in claim 5 in which the breech block is rotatable between a "firing" position in which a recess in the skirt aligns with a slot to receive a laterally extending slide, and "safe" position in which the edge of said skirt obscures the path of movement of said slide to prevent firing of the firearm.

7. A personal protection firearm as claimed in claim 1 wherein the trigger mechanism has a lateral protrusion fixed to the plate for engagement by the thumb of a user to fire the firearm.

* * * * *